US006488348B1

(12) United States Patent
Miura et al.

(10) Patent No.: US 6,488,348 B1
(45) **Date of Patent: *Dec. 3, 2002**

(54) INK-JET PRINTING APPARATUS

(75) Inventors: Yasushi Miura, Kawasaki (JP); Katsuhiro Watanabe, Kawasaki (JP); Makoto Aoki, Yokohama (JP); Toshiaki Mabuchi, Tama (JP); Tomoyuki Kawana, Yokohama (JP); Takeshi Irizawa, Oizumi-machi (JP); Chikanobu Ikeda, Tokyo (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/370,904

(22) Filed: Aug. 10, 1999

Related U.S. Application Data

(62) Division of application No. 08/625,705, filed on Apr. 3, 1996, now Pat. No. 5,988,782.

(30) Foreign Application Priority Data

Apr. 7, 1995 (JP) ..... 7-082973
Oct. 9, 1995 (JP) ..... 7-261830

(51) Int. Cl.[7] ..... B41J 2/195; B41J 29/393
(52) U.S. Cl. ..... 347/6; 347/19
(58) Field of Search ..... 347/19, 85, 89, 347/6, 84, 95, 100, 5, 7

(56) References Cited

U.S. PATENT DOCUMENTS

| | | | | |
|---|---|---|---|---|
| 3,761,953 A | | 9/1973 | Helgeson et al. | 347/7 |
| 4,313,124 A | | 1/1982 | Hara | 347/57 |
| 4,345,262 A | | 8/1982 | Shirato et al. | 347/10 |
| 4,459,600 A | | 7/1984 | Sato et al. | 347/47 |
| 4,463,359 A | | 7/1984 | Ayata et al. | 347/56 |
| 4,523,854 A | | 6/1985 | Beckley | 366/132 |
| 4,558,333 A | | 12/1985 | Sugitani et al. | 347/65 |
| 4,608,577 A | | 8/1986 | Hori | 347/66 |
| 4,649,064 A | | 3/1987 | Jones | 427/256 |
| 4,723,129 A | | 2/1988 | Endo et al. | 347/56 |
| 4,740,796 A | | 4/1988 | Endo et al. | 347/56 |
| 4,812,856 A | | 3/1989 | Wallace | 347/89 |
| 5,357,347 A | | 10/1994 | Hirose et al. | 358/296 |
| 5,451,987 A | | 9/1995 | Perrin | 347/6 |
| 5,506,611 A | | 4/1996 | Ujita et al. | 347/86 |
| 5,596,353 A | | 1/1997 | Takada et al. | 347/19 |
| 5,854,307 A | * | 12/1998 | Kimura et al. | 347/100 |
| 5,877,797 A | * | 3/1999 | Miyashita et al. | 347/6 |
| 5,963,236 A | * | 10/1999 | Miyashita et al. | 347/85 |
| 6,027,200 A | * | 2/2000 | Takahashi et al. | 347/19 |
| 6,039,442 A | * | 3/2000 | Hagiwara et al. | 347/89 |

FOREIGN PATENT DOCUMENTS

| | | |
|---|---|---|
| EP | 0 573 274 | 12/1993 |
| EP | 0 604 938 | 7/1994 |
| EP | 0 646 460 | 4/1995 |
| EP | 0 650 846 | 5/1995 |

(List continued on next page.)

*Primary Examiner*—Anh T. N. Vo
*Assistant Examiner*—An H. Do
(74) *Attorney, Agent, or Firm*—Fitzpatrick, Cella, Harper & Scinto

(57) ABSTRACT

In an ink-jet printing apparatus, upon turning on the power source of the printing apparatus, a stirring operation of ink in the main tank is performed for a given period of time, and during subsequent printing operation, the stirring operation in the main tank is performed for the given period at every predetermined elapsed time period. By this, the printing operation for a long period can be performed employing ink having a water insoluble dye without causing a problem of admixing of bubble or so forth caused by stirring of the ink in the main tank.

15 Claims, 14 Drawing Sheets

FOREIGN PATENT DOCUMENTS

| | | | | |
|---|---|---|---|---|
| EP | 0 661 162 | | 7/1995 | |
| JP | 54-056847 | | 5/1979 | |
| JP | 55-71573 | | 5/1980 | |
| JP | 55-87568 | | 7/1980 | |
| JP | 56-37162 | | 4/1981 | |
| JP | 59-123670 | | 7/1984 | |
| JP | 59-138461 | | 8/1984 | |
| JP | 60-071260 | | 4/1985 | |
| JP | 61-057342 | | 3/1986 | |
| JP | 363147648 A | * | 6/1988 | ..... 347/85 |
| JP | 3-67657 | | 3/1991 | |
| JP | 3-146356 | | 6/1991 | |
| JP | 4-190838 | | 7/1992 | |
| JP | 4-201341 | | 7/1992 | |
| JP | 4-366646 | | 12/1992 | |
| JP | 5-229140 | | 9/1993 | |
| JP | 5-338195 | | 12/1993 | |
| JP | 6-155758 | | 6/1994 | |
| JP | 7-35034 | | 2/1995 | |
| JP | 7-117223 | | 5/1995 | |

* cited by examiner

INK-JET PRINTING APPARATUS

This application is a divisional application of U.S. patent application Ser. No. 08/625,705, filed Apr. 3, 1996 now U.S. Pat. No. 5,988,782.

BACKGROUND OF THE INVENTION

1. Field of the Invention

The present invention relates generally to an ink-jet printing apparatus. More specifically, the invention relates to an ink-jet textile printing apparatus for performing printing on a cloth or so forth.

2. Description of the Related Art

As typical method for performing printing on a cloth, a wall paper and so forth, a screen textile printing method for performing direct printing on the cloth and so forth employs a silk screen printing plate. In this method, with respect to an original image, at first, the silk screen printing plates are prepared for respective colors used in the original image. Then, the silk screen printing plate is loaded on a screen textile printing apparatus to perform printing by directly transferring an ink to the cloth or so forth through a mesh of the silk screen printing plate.

However, in such screen textile printing method, a huge amount of process steps and working days are required for preliminarily preparing the silk screen printing plates. Further operation is required for blending of inks for respective colors, and registering of the silk screen printing plate per each color. In addition, the screen textile printing apparatus per se is bulky, and the size of the apparatus is increased in proportion to number of colors to be used to require a substantial space for installation. Also, a space for storing the silk screen printing plates become necessary.

Therefore, it has been proposed an ink-jet textile printing system for performing printing directly on a printing medium, such as the cloth, the wall paper and so forth. The ink-jet textile printing system is to eject a fine ink droplet through ejection openings of an ink-jet head to perform printing an image or so forth by forming ink dots on the printing medium. The ink-jet textile printing system has many advantages such that there is not required the screen printing plate which has been required in a conventional screen textile printing system, and process steps and working days for forming the image on the cloth significantly shorten. Furthermore, the ink-jet textile printing system is advantageous for capability of down-sizing of the apparatus. In addition, since printing information for printing can be stored in various storage media, such as tape, flexible disk, optical disk and so forth, the ink-jet textile printing system is superior in safekeeping and storage of the printing information. Furthermore, the ink-jet textile printing system is advantageous in easiness of processing of the printing information, such as changing of color, layout, expansion and contraction of the image and so forth.

On the other hand, cloths, as printing medium to be employed in the ink-jet textile printing system, extend in wide variety, such as natural fibers, e.g. cotton, silk, wool and so forth, synthetic fibers, e.g. nylon, rayon, polyester and so forth, and mixed fabric of these fibers. Accordingly, in order to satisfactorily perform printing for the cloths consisted of such wide variety of fibers, it is desirable to adapt dye of the ink to a material of respective fibers. For example, reactive dye is preferred for cotton and silk, acid dye is preferred for nylon, disperse dye is preferred for polyester fiber, metal complex salt dye is preferred for wool, and vat dye or pigment is preferred for cotton. Amongst, disperse dye, metal complex dye, vat dye and pigment are known as a coloring agent insoluble in water or a coloring agent having low solubility in water.

Associating with necessity of use of inks depending upon kinds of the printing medium, following several problems occur.

First of all, in order to prepare water based ink employing water insoluble dye or dye having low solubility, it is typically performed to prepare fine particle of material of dye and to disperse the fine particle dye material into water by dispersing agent for emulsification. However, when the water based ink in which the dispersing agent is dispersed and emulsified, coagulation and sedimentation of the dye in the ink can be caused as the time going to cause variation of dye density resulting in fluctuation of printing density, or, in turn to cause plugging of an ink passage.

With respect to such problem, there has been proposed in Japanese Patent Application Laid-open No. 57342/1986 to provide a function for stirring the ink to prevent the coagulation or the sedimentation of the dye in the ink by constantly operating such stirring function.

However, only by the construction of the prior art proposed in the above-identified publication, it can be insufficient for satisfactorily using the water based ink employing the water insoluble or the dye having low solubility.

For example, in the case that a motor for performing stirring is driven constantly during use of the ink-jet textile printing apparatus, it is inherent that a bubble is generated in the ink and dissolved oxygen is absorbed into the ink. Even when stirring force is made smaller, it is still difficult to completely avoid generation of the bubble. In such case, according to elevating of an ink temperature, the bubble and the dissolved oxygen may be grown to form a greater bubble. Such large bubble may be a cause of faulty ejection, such as ink ejection failure and so forth. The problem of the faulty ejection caused by the grown bubble is particularly remarkable in the case where a head of the system for ejecting the ink by generating bubble utilizes thermal energy.

On the other hand, in the case that a period of stirring is excessively long, it is experimentally confirmed that dispersing ability of the dye can be lowered to cause fluctuation of the printing density. A reason for causing the fluctuation is estimated as follows. By stirring, a possibility of collision between dye molecules can be increased to accelerate coagulation, and the sedimentation of the dye can be promoted to cause non-uniformity of the ink density. Also, by acceleration of the coagulation, an average grain size of the dye becomes greater to cause plugging in a filter in the ink passage or plugging in the ejection openings.

Furthermore, a construction of the prior art is not practical even in the viewpoint of a life of a stirring motor. More specifically, in the case of a textile printing apparatus, different from an ordinary printer used in an office, it is typical to be operated continuously over whole days, i.e. 24 hours, and requires durability of the apparatus over 5 years or more, as industrial facility. Accordingly, a required lift for the stirring motor should be quite long in operation period. It is quite difficult to find out the motor satisfying such requirement. On the other hand, as one solution for solving such problem, the motor may be replaceable. However, this is not desirable in view of construction of the overall apparatus and in the viewpoint of cost.

Secondly, among various dyes, properties are differentiated such that the reactive dye and acid dye are water soluble, whereas dispersing dye, metal complex salt dye, vat dye and pigment are water insoluble or have low solubility. Accordingly, physical property, characteristics and so forth of the inks are differentiated.

However, in the conventional ink-jet textile printing apparatus, when the inks having different properties are used, dedicated apparatus adapted for respective inks are employed and set to a use condition adapted to respectively corresponding inks. Therefore, cost for printing is increased. Also, a large space is required for installing a plurality of textile printing apparatuses.

SUMMARY OF THE INVENTION

It is an object of the present invention to provide an ink-jet printing apparatus which can satisfactorily perform printing with employing an ink containing water insoluble dye or dye having low solubility without causing a problem of bubbling caused by stirring of the ink even when the apparatus is continuously operated for a long period.

Another object of the present invention is to provide an ink jet printing apparatus which makes stirring operation of stirring means variable to make it possible to intermittently perform stirring operation for a predetermined period during printing operation of the printing apparatus, for example.

A further object of the invention is to provide an ink-jet printing apparatus which permits use of a plurality of kinds of inks in a single apparatus and thus is suitable for textile printing.

A still further object of the invention is to provide an ink-jet printing apparatus which can identify kind of inks, select one of predetermined printing modes depending upon the identified kind of ink and perform printing in the selected printing mode.

In a first aspect of the present invention, there is provided an ink-jet printing apparatus for performing printing by ejecting an ink to a printing medium by using an ink-jet head, comprising:

executing means for executing operation associated with printing and specific to a kind of ink to be employed in printing.

In a second aspect of the present invention, there is provided an ink-jet printing apparatus for performing printing by ejecting an ink to a printing medium by using an ink-jet head comprising:

ink supply means for supplying the ink to the ink-jet head;

stirring means provided in a part of the ink supply means for stirring the ink to be supplied; and stirring control means for making stirring operation of the stirring means variable.

In a third aspect of the present invention, there is provided an ink-jet printing apparatus for performing printing by ejecting an ink to a printing medium by using an ink-jet head, comprising:

judging means for making judgement of kind of the ink to be ejected from the ink-jet head;

setting means for preliminarily setting printing mode per kind of ink; and control means for selecting one printing mode among printing modes preliminarily set by the setting means depending upon kinds of ink judged by the judging means and for performing printing of the printing mode selected.

BRIEF DESCRIPTION OF THE DRAWINGS

The present invention will be understood more fully from the detailed description given herebelow and from the accompanying drawings of the preferred embodiment of the invention, which, however, should not be taken to be limitative to the present invention, but are for explanation and understanding only.

In the drawings.

DESCRIPTION OF THE PREFERRED EMBODIMENT

The preferred embodiments of the present invention will be discussed hereinafter with reference to the accompanying drawings. In the following description, numerous specific details are set forth in order to provide a thorough understanding of the present invention. It will be obvious, however, to those skilled in the art that the present invention may be practiced without these specific details. In other instance, well-known structures are not shown in detail in order not to unnecessarily obscure the present invention.

Figure 1:
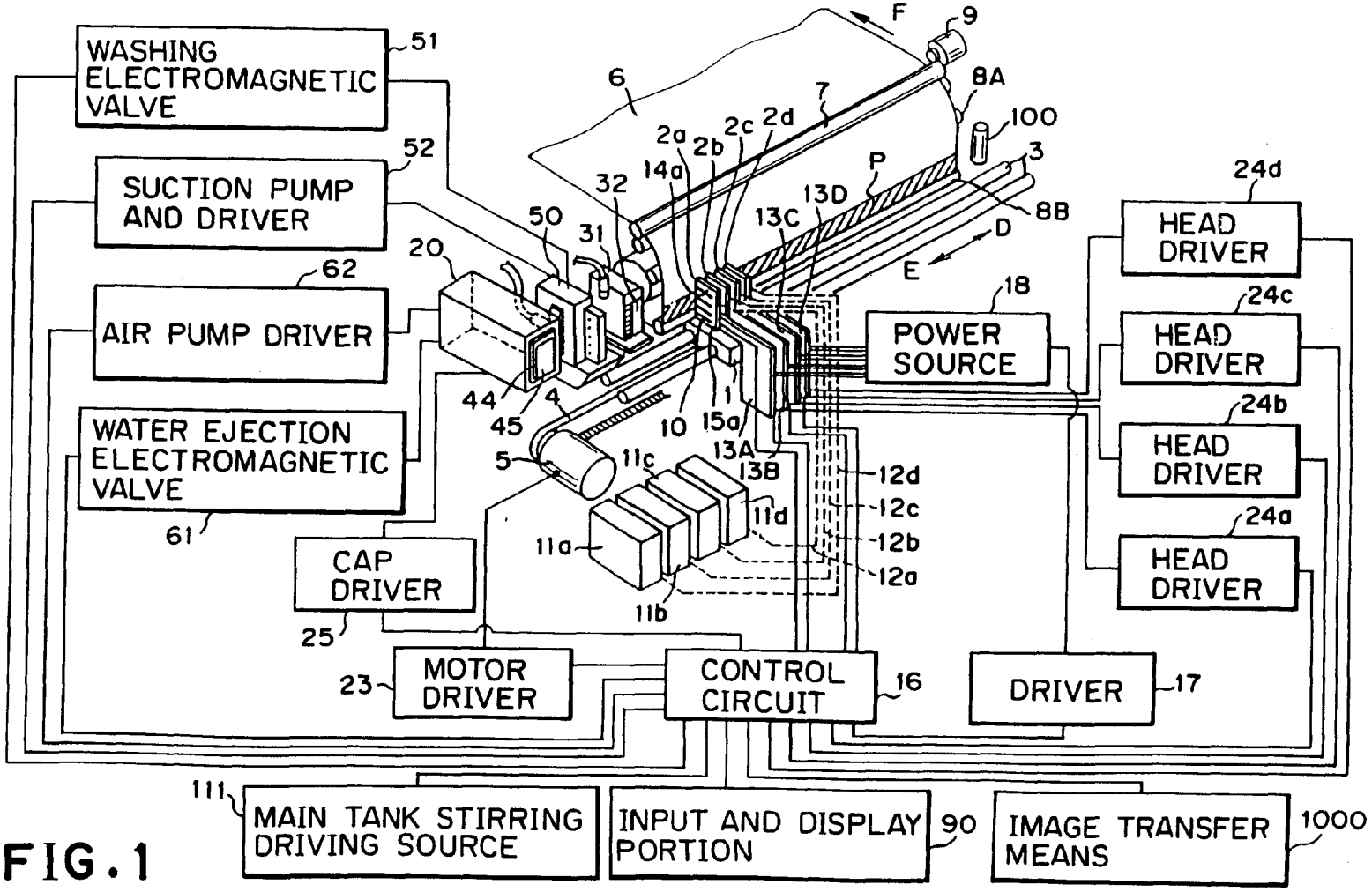
FIG. 1 is an illustration showing general construction of one embodiment of an ink-jet printing apparatus according to the present invention.

FIG. 1 is an illustration showing a general construction of one embodiment of an ink-jet printing apparatus according to the present invention.

In FIG. 1, a carriage 1 mounts printing heads 2*a*, 2*b*, 2*c* and 2*d* respectively ejecting inks of cyan, magenta, yellow and black. Two guide shafts 3 movably support the carriage 1 to guide it. A part of a belt 4 in an endless belt form is connected to the carriage 1. A driving force of a driving motor 5 of a pulse motor, driving of which is controlled by a motor driver 23, is transmitted to the carriage 1. By this, the carriage 1 may move on the guide shaft 3 along a printing surface of a printing medium (hereinafter referred to as "printing paper"), such as a paper, OHP film, cloth and so forth. Furthermore, the printing paper 6 is conveyed by a conveying roller 7 for conveying the printing paper 6, a guiding rollers 8A and 8B for guiding the printing paper 6 and printing paper conveying motor 9 and so forth.

In each of printing heads 2*a*, 2*b*, 2*c* and 2*d*, ejection openings for ejecting ink droplet and liquid passages (not shown) communicated thereto are provided. On the other hand, for respective printing heads, inks are supplied from respectively corresponding ink tanks 11*a*, 11*b*, 11*c* and 11*d* via supply tubes 12*a*, 12*b*, 12*c* and 12*d*. In each liquid passage of respective printing heads, there is provided an electrothermal transducing element which generates thermal energy utilized for ejecting ink. To these elements, ink ejection signals are selectively supplied from respective head drivers 24*a*, 24*b*, 24*c* and 24*d* via flexible cables 13*a*, 13*b*, 13*c* and 13*d*, respectively. Furthermore, in each of printing heads 2*a*, 2*b*, 2*c* and 2*d*, a head heater and a temperature detecting sensor are provided. A control circuit 16 controls heating of the head heater through a driver 17 and a power source 18 on the basis of a temperature detection signal from the temperature detecting sensor.

Capping units 20 are adapted to contact with an ejection surface of respective printing heads 2*a*, 2*b*, 2*c* and 2*d* during non-printing state for serving to prevent viscosity of the ink in the printing heads from increasing upon non-printing state. More specifically, in non-printing state, the carriage 1 mounting the printing heads 2*a*, 2*b*, 2*c* and 2*d* are shifted to the position opposing to the capping units 20. Subsequently, the capping units 20 are shifted towards respective printing heads by driving force of a motor (not shown) driven by a capping driver 25 to press elastic members 44 provided on the front faces of the respective cap units 20 onto ejection surfaces so that capping for the respective printing heads can be performed. Within each capping unit 20, a liquid absorbing member which can maintain wet condition with the ink, is provided. By this, the inside of the capping unit can be maintained at high humidity to minimize increasing of viscosity of the ink.

Figure 2:
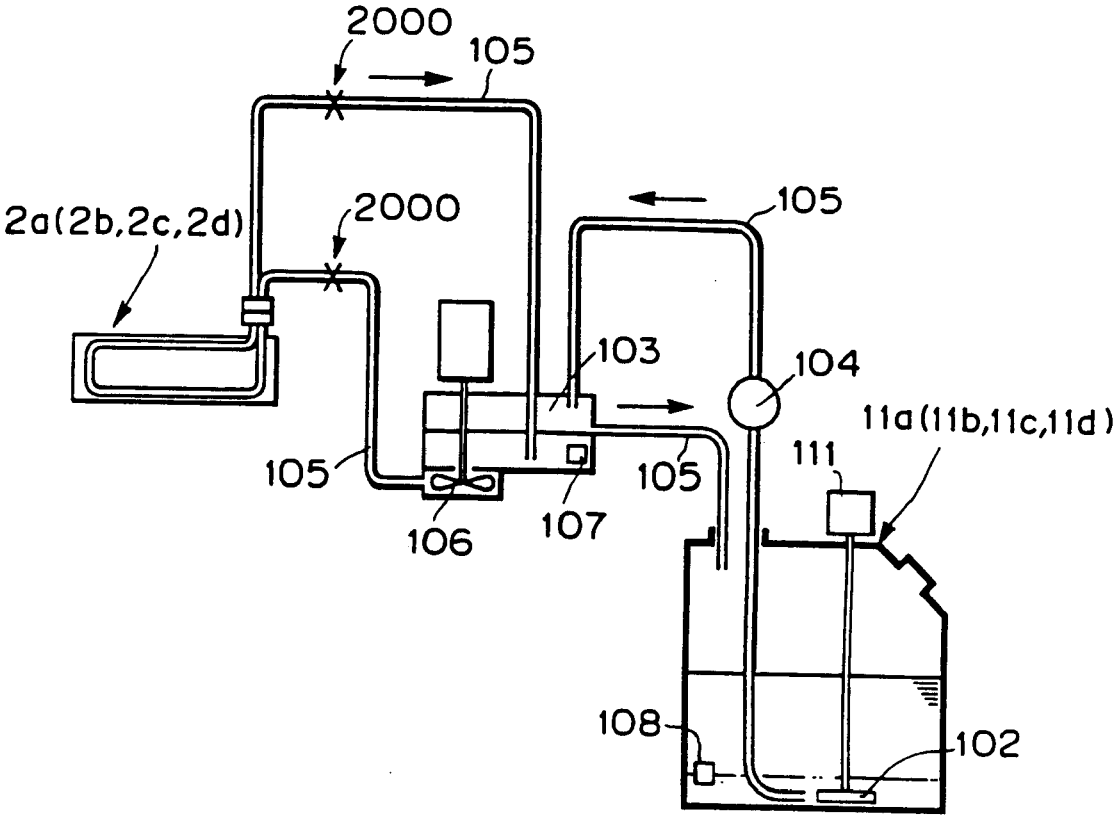
FIG. 2 is a diagrammatic illustration showing an ink supply system in the apparatus shown in FIG. 1.

FIG. 2 is a diagrammatic illustration showing detailed construction of an ink supply passage in the ink-jet printing apparatus.

In the ink supply passage between the main tank 11*a* (11*b*, 11*c* and 11*d*) and the printing head 2*a* (2*b*, 2*c* and 2*d*), a sub-tank 103 (not shown in FIG. 1) is provided for stabilizing ejection by maintaining a constant water head difference. On the other hand, respective components constituting an ink supply system are connected through an ink supply tube 105. Ink supply from the sub-tank 103 to the head 2*a* is normally performed depending upon ejecting operation of the head 11*a* by capillary effect. On the other hand, During ejection recovery operation of the head discussed later, the ink is forcedly supplied to the printing head 2*a* by means of a sub-tank pump 106.

It should be noted that, in the construction set forth above, control of ink supply to the sub-tank 103 is performed by driving the pump 104 depending upon a detection signal from an ink level sensor 107 provided in the sub-tank. On the other hand, in the main tank 11*a*, a similar liquid level sensor 108 is provided. By this, when ink amount in the main tank becomes small, an alarm may be generated to a user on the basis of the detection output from the sensor 108 to urge the user to supply the ink to the main tank.

In the main tank 11*a* (11*b*, 11*c*, 11*d*), an ink stirring member 102 is provided and is rotatingly driven by a driving source 111, such as a motor or so forth. Thus, the ink stored in the main tank 11*a* is stirred to prevent coagulation or sedimentation of dye in the ink. The ink stirring member 102 is a member having 50 mm in length, 20 mm in width and 10 mm in thickness. It should be noted that driving of the ink stirring member 102 is controlled by the control circuit 16 (see FIG. 1). More specifically, as discussed later, the ink stirring member 102 is driven intermittently at predetermined timing.

On the other hand, even other than the main tank 11*a*, when the apparatus is maintained in the non-printing state for a long period, it is possible to cause coagulation or sedimentation of the dye of the ink. However, this can be prevented by ink flow associating with an ejection recovery operation. Also, the coagulated ink may be discharged through the ejection openings of the printing head.

The ejection recovery operation is performed after resting in long period, after initiation of printing and during printing operation, for example. For instance, when the apparatus is maintained in the non-printing state for a long period, even in the capping state, the ink in neighborhood of the ejection opening is moderately evaporated to cause increasing of viscosity. Also, fine bubble generated in inside of the ejection opening or mixed in the ink in inside of the ejection opening may grow into greater bubble. Therefore, upon turning ON of power for the printing apparatus after leaving in non-operating state for a long period, or upon initiation of printing, the pump 106 provided in the sub-tank 103 is driven to pressurize the ink for forcedly discharging the high viscous ink and residual bubbles in inside of the ejection opening therefrom. In addition, by performing the ejection recovery operation during printing operation, even when a dust or water droplet depositing on the ejection surface, or dust or so forth penetrates into the ejection opening, those can be washed out to maintain stable ejection.

Again, referring to FIG. 1, a plugging preventing unit 31 is designed for receiving ejected ink when so-called preliminary ejection is performed in the printing heads 2*a*, 2*b*, 2*c* and 2*d*. More specifically, the plugging preventing unit 31 mates with the printing heads 2*a*, 2*b*, 2*c* and 2*d* while the latter is shifted. The plugging preventing unit 31 has a liquid receptacle member 32 as a liquid receiving portion for absorbing the inks ejected from respective heads and is located between the capping units 20 and the print start position of the carriage 1.

In a cleaning unit 50, an electromagnetic valve 51 for cleaning, a suction pump and a driver 52 are connected. These components are controlled for driving by the control circuit 16, respectively to apply a cleaning liquid to a wiping blade and absorb the cleaning liquid.

Figure 3:
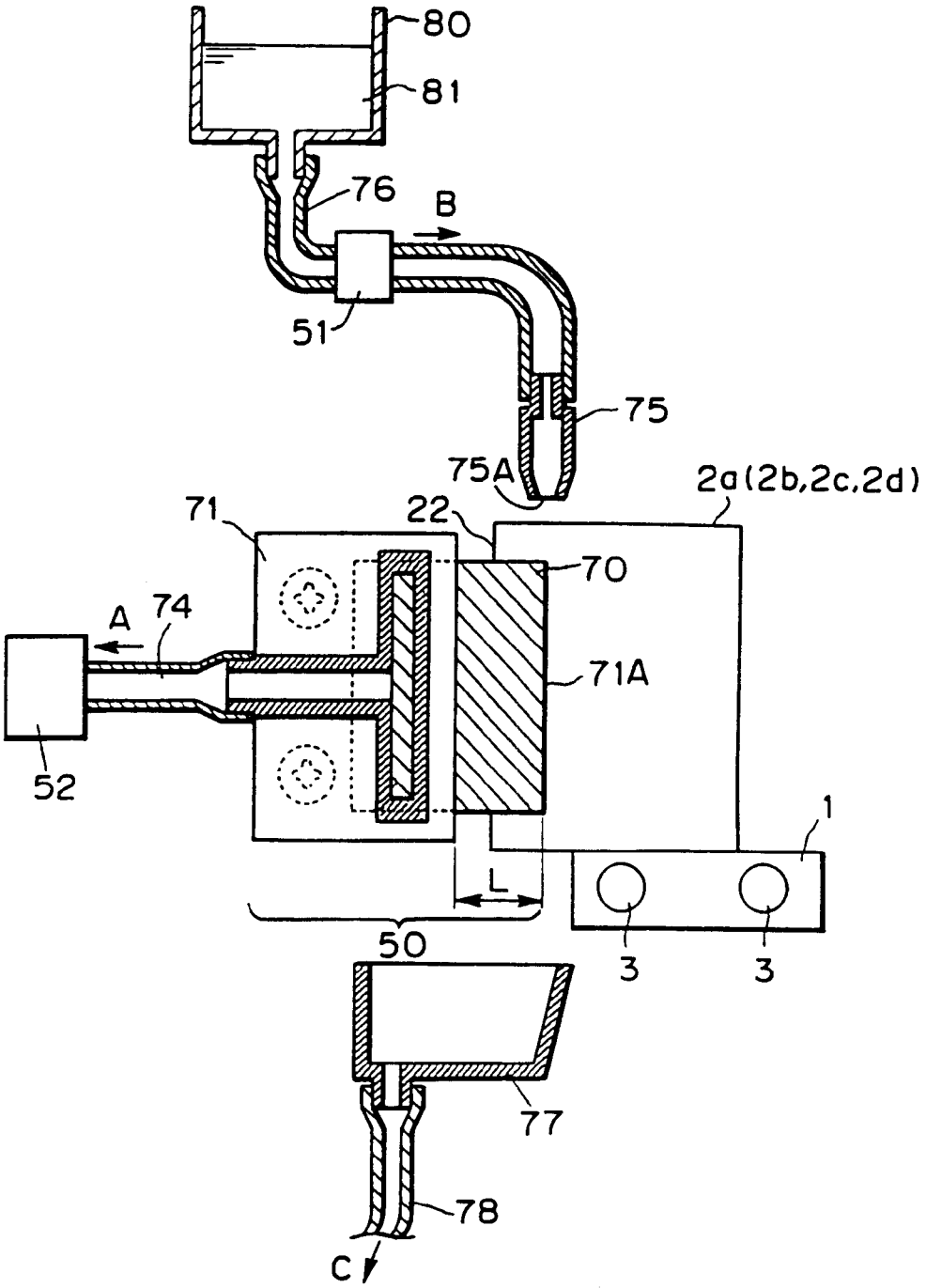
FIG. 3 is a section showing a detailed construction of a cleaning unit in the apparatus shown in FIG. 1.
Figure 4:
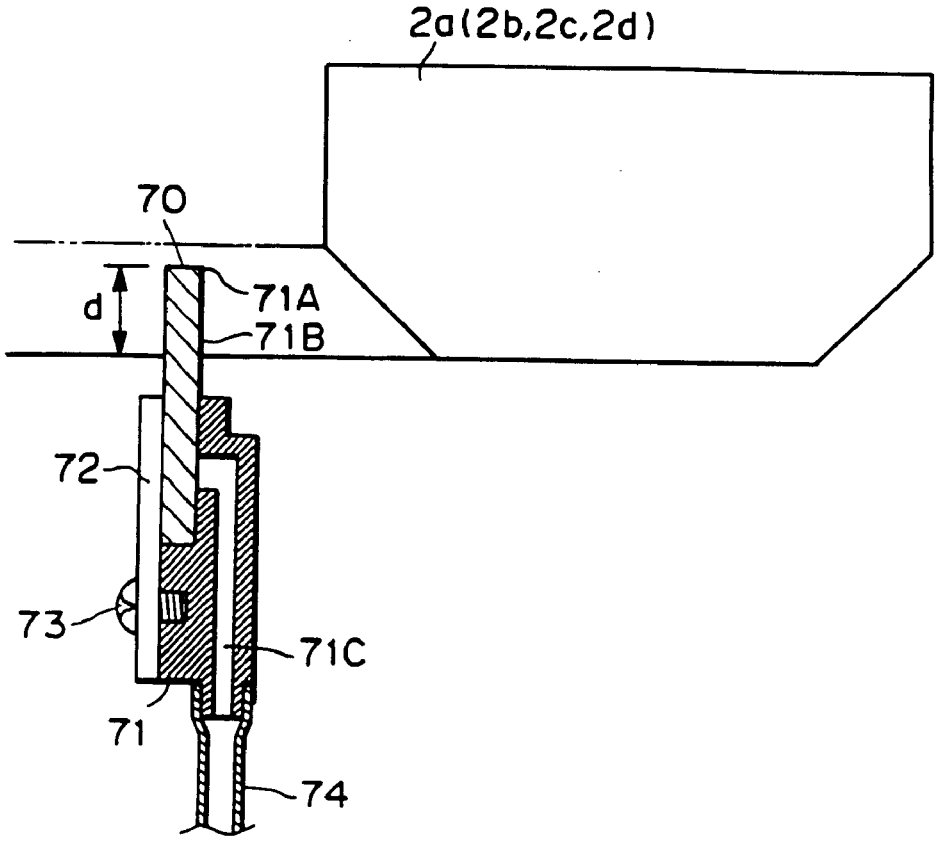
FIG. 4 is an illustration showing positional relationship between a blade of the cleaning unit and a printing head.

FIGS. 3 and 4 are illustrations showing detail of the cleaning unit 50. Here, FIG. 3 is an explanatory illustration of the cleaning unit 50 as viewed in the primary scanning direction, and FIG. 4 is an explanatory illustration when a blade 70 and the head 2*a* are viewed from the above.

The blade 70 is formed of a flexible porous body. It is preferred that the blade is formed of a material which does not cause significant volume variation after the ink is absorbed, instead of the material which causes volume variation upon absorption of ink mist, such as high polymer foamed body. For example, a formal resin type flexible porous body is preferable.

Figure 5:
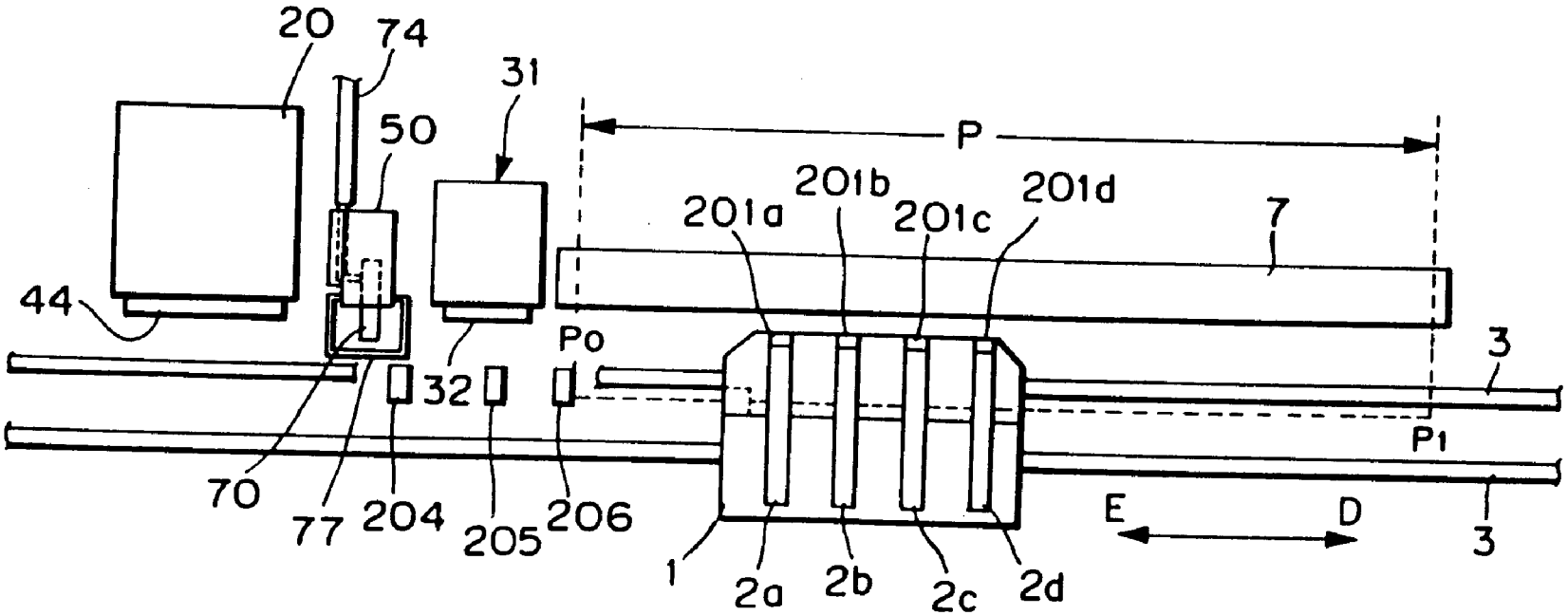
FIG. 5 is an upper plan view of the apparatus for explaining an ejection recovery operation and printing operation in the apparatus of FIG. 1.

FIG. 5 is a top plan view showing general construction of a printing operation portion in the shown embodiment of the ink-jet printing apparatus.

In FIG. 5, the carriage 1 mounting the printing heads 2*a*, 2*b*, 2*c* and 2*d* is shifted within a printing region P defined between a point P0 and a point P1 to perform printing by ejecting inks of cyan (C), magenta (M), yellow (Y) and black (Bk). When printing operation is not performed, the carriage 1 is shifted to a position where respective printing heads mate with the capping members 44 for capping operation. A reference numeral 204 denotes a capping position detecting sensor for detecting the carriage shifted into the capping position, a reference numeral 205 denotes a preliminary ejection position detecting sensor for detecting the carriage 1 shifted into the position in opposition to the plugging preventing unit 31, a reference numeral 206 denotes a print start position detecting sensor for detecting the carriage reaching at the print start position.

Cleaning operation by the cleaning unit 50 constructed as set forth above is performed in the following manner. By shifting the carriage 1 mounting the printing heads 2*a* to 2*d* from the capping position (see FIG. 5) to a direction shown by arrow D in FIG. 5, the blade 70 comes into contact with the ejection surface of the printing heads to remove ink droplet and so forth on the ejection surfaces 201*a* to 201*b* with deflecting the tip end portion of the blade 70. At this time, the cleaning liquid is applied to the blade 70 to clean up the ejection surface by the cleaning liquid. The cleaning liquid thus used can be sucked and discharged by the suction pump 52. It should be noted that a porous member or fibrous member may be provided adjacent to or in continuation with the blade 70 for absorbing and discharging the cleaning liquid in place of the suction pump. Thus, by appropriately reducing the amount of cleaning liquid residing in the blade 70, suction performance can be recovered.

Hereinafter, discussion will be given for procedure of printing operation and respective operation associated with printing operation in the shown embodiment of the ink-jet printing apparatus. As set forth above, in FIG. 5, the print start position detecting sensor 206 and the capping position detecting sensor 204 respectively detect the printing heads 2*a*, 2*b*, 2*c* and 2*d* at print start position and capping position, respectively. Also, the preliminary ejection position detecting sensor 205 detects the printing heads 2*a* to 2*d* reaching a reference position of the preliminary ejection performed while the printing heads are shifted in scanning direction.

Figure 7:
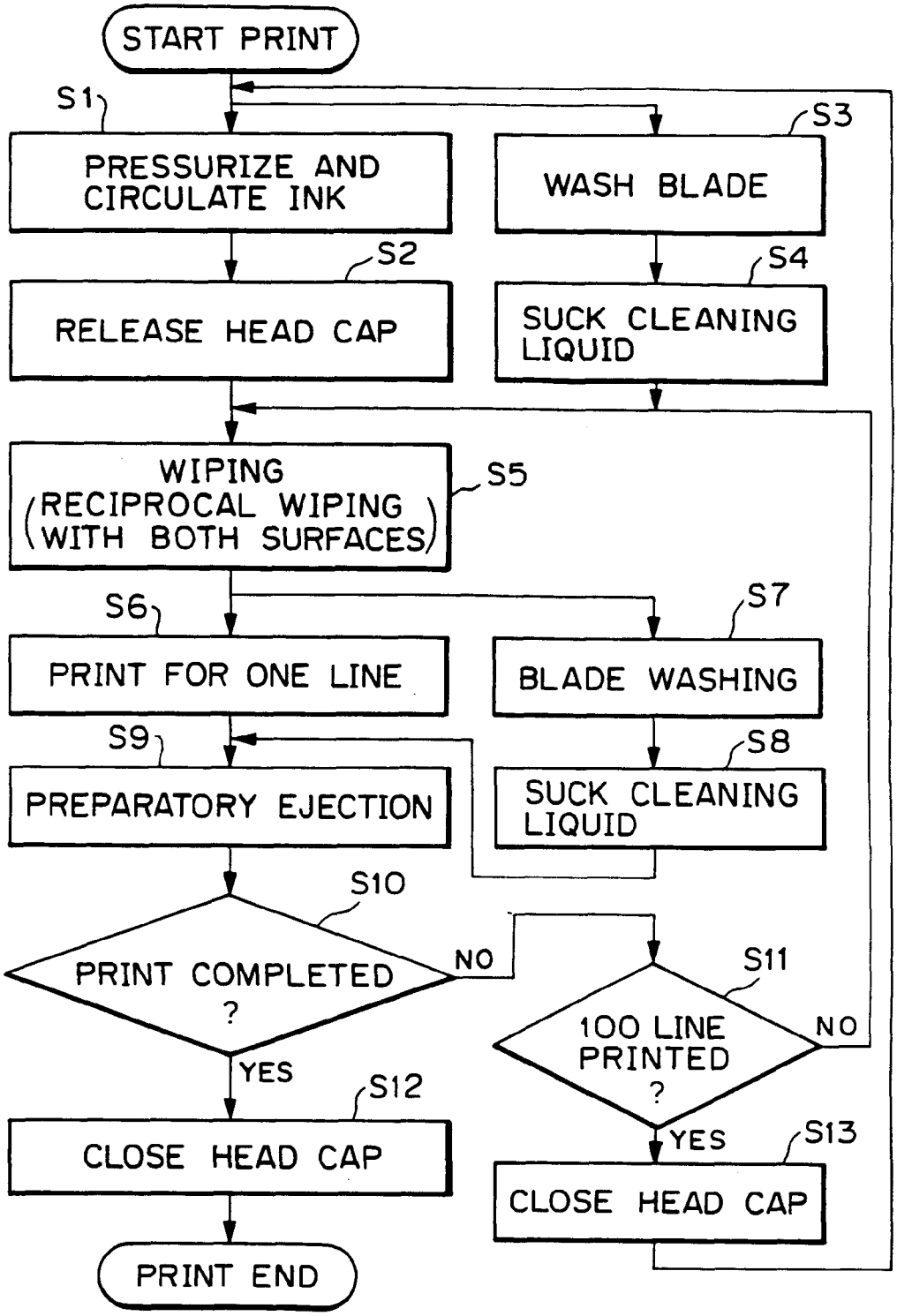
FIG. 7 is a flowchart showing procedure of general printing operation in the apparatus of FIG. 1.

FIG. 7 is a flowchart showing a sequence of printing operation and so forth. At first, in print stand-by state, respective ejection surfaces 201*a*, 201*b*, 201*c* and 201*d* of the printing heads 2*a*, 2*b*, 2*c* and 2*d* are capped by the capping units 20. In such stand-by condition, when a print start signal is input to the control circuit 16 (see FIG. 1), pressurized circulation of the ink is initiated by the pump 106 shown in FIG. 2, at step S1. After completion of pressurized circulation of ink at step S1, the capping members 44 are driven by the capping driver 62 in the direction for opening respective printing heads, at step S2.

In conjunction with the ink pressurizing and circulating operation set forth above, cleaning of the blade 70 by the cleaning liquid is performed at step S3. By cleaning, high viscous ink and foreign matter deposited on the blade 70 are washed off together with the cleaning liquid.

Next, at step S4, the cleaning liquid is sucked by the pump 52. By this, the residual cleaning liquid amount in the blade 70 is appropriately reduced to enhance capturing performance for the ink and the foreign matter and thus to enhance cleaning effect. Also, by sucking of the cleaning liquid, negative pressure is generated within the porous body forming the blade 70 by capillary effect to make this negative pressure to be greater than that exerted on the ejection openings of the printing heads. Thus, suction of the ink from the ejection opening and the liquid passage upon cleaning can be facilitated. Furthermore, by this, penetration of the cleaning liquid into the liquid chamber can be successfully prevented. In addition, application of the negative pressure may generate ink suction force in the liquid passage to contribute for removal of high viscous ink in the liquid passage.

Next, by supplying the drive signal to the motor driver 23, the driving force of the driving motor 5 is transmitted to the carriage 1 via the belt 4 to shift the carriage 1 into the printing region. By this, at step S5, the ejection surface is sequentially wiped by the blade 70 as passing through the position opposing to the cleaning unit 50 as discussed with respect to FIG. 6, for cleaning. It should be noted that a wiping operation set forth above means removal of the cleaning liquid, ink and foreign matter and so forth from the ejection surface.

Figure 6:
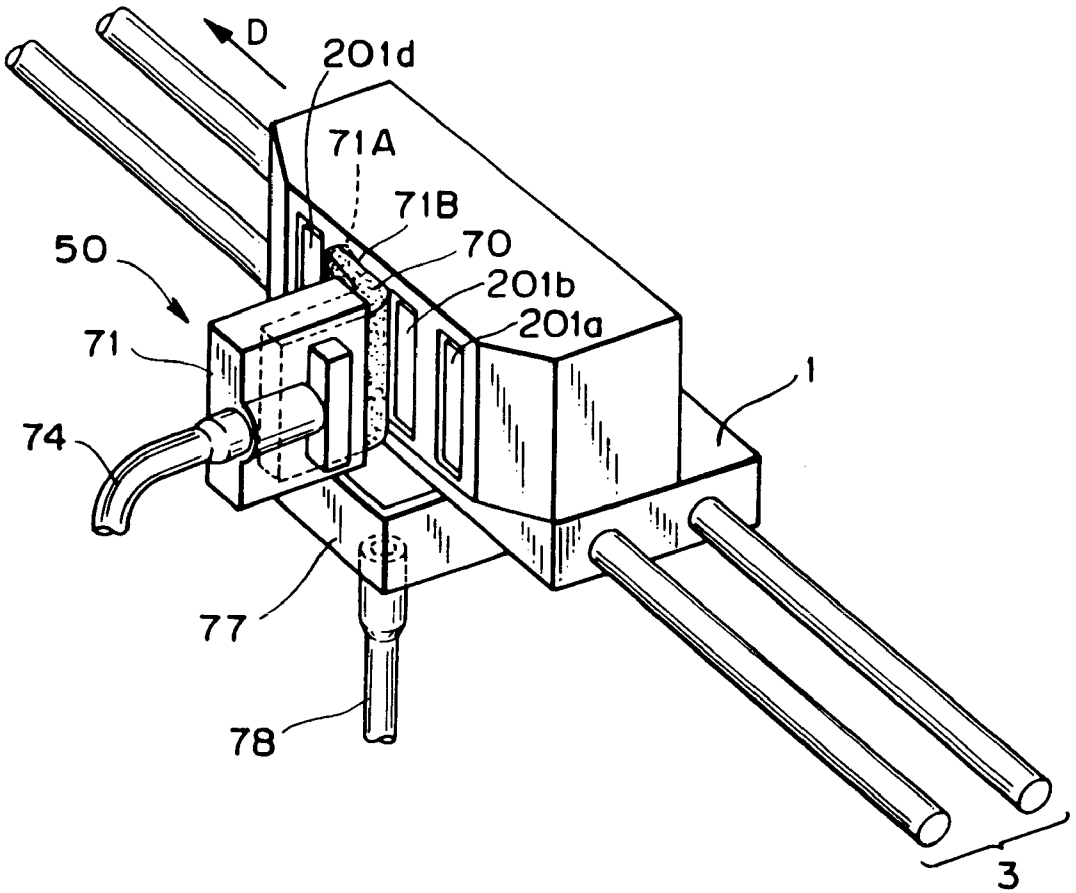
FIG. 6 is a perspective view illustrating cleaning operation to be performed as a part of the ejection recovery operation.

Upon wiping of the ejection surface by means of the blade 70 as shown in FIG. 6, since the blade 70 has flexibility, it can be deflected following to shifting of the carriage in the direction D of FIG. 6 to wipe the ejection surface by a wiping surface 71B with small elastic force to perform cleaning. Therefore, even when a step is present between a surface of the head holder and the ejection surface, cleaning effect will not be affected. Particularly, an edge portion 71A of the blade 70 enters into a recessed portion of the holder 23, and it becomes possible to clean a step portion between the holder and the ejection surface.

At step S6, ink droplets are ejected while the carriage travels in the direction of arrow D in FIG. 5 from the print start detecting position P0 detected by the print start position detecting sensor 206 to perform printing of image in the printing region P of the printing paper 6 (see FIG. 1).

At the same time, at step S7, washing of the blade 70 is performed, and at subsequent step S8, suction of the cleaning liquid is performed for recovery of cleaning function of the blade 70. Subsequently, the traveling direction of the carriage 1 is reversed to be driven in the direction of arrow E (see FIG. 5). At step S9, upon passing through the preliminary ejection position (opposing to the plugging preventing unit 31), the preliminary ejection is performed. It should be noted that the preliminary ejection is performed toward the liquid receptacle portion 32. During this period, the printing paper 6 is fed in the direction of arrow F (see FIG. 1) in the magnitude corresponding to the width of the printing region P.

Next, judgement is made whether printing is completed or not at step S10. If not, the process is advanced to step S11 to make judgement whether printing for 100 lines is completed or not. If the result of judgement is negative, process returns to step S5 to repeated operations of step S6 and subsequent steps. In a wiping step of step S5, since only one of wiping surfaces 71B of the blade 70 is used for wiping in the forward shifting of the carriage, wiping of the ejection surface in the backward shifting of the carriage is not performed by the wiping surface 71B which is stained once. Therefore, the stained wiping surface will never affect the cleaning effect, rather the cleaning effect can be enhanced to be double.

On the other hand, when the result of judgement in step S10 is positive, the process is advanced to step S12 to cap the ejection surfaces of respective printing heads by the capping units 20 and then the printing operation is terminated. Also, when the result of judgement in step 11 is positive, the process is advanced to step S13 to cap the ejection surfaces and then the process returns to steps S1 and S3 to repeat operations of these steps and subsequent steps.

Several embodiments of the present invention based on the shown embodiment of the ink-jet printing apparatus set forth above will be discussed hereinafter.

(First Embodiment)

Figure 8A:
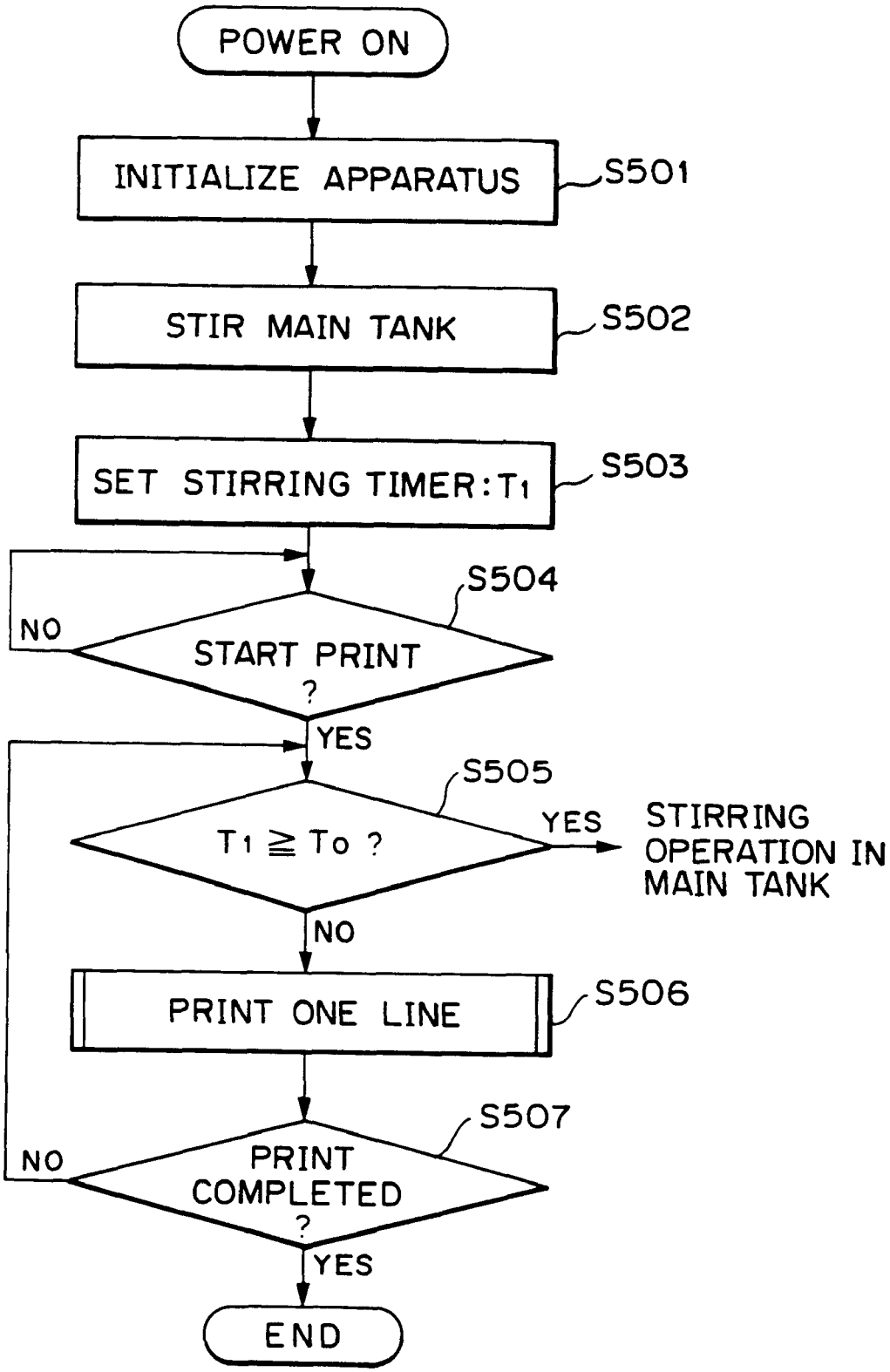
FIGS. 8A and 8B are flowcharts showing procedure of main tank stirring process in a first embodiment of the present invention.
Figure 8B:
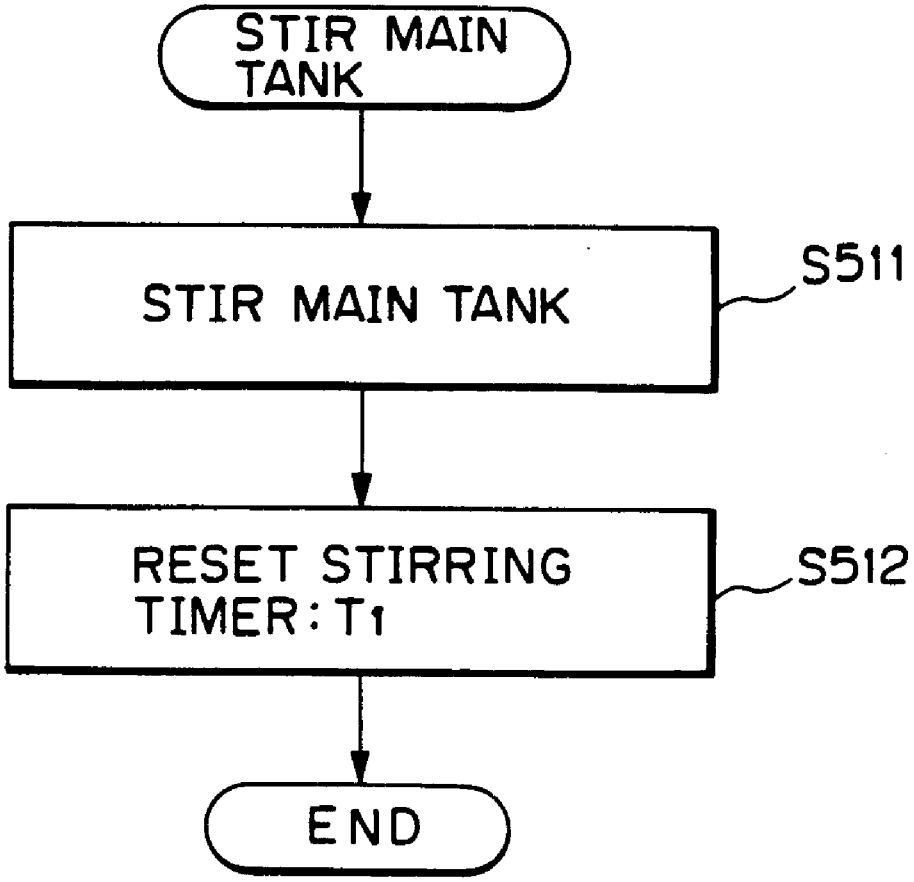

FIGS. 8A and 8B are flowcharts showing general sequence of printing operation including main tank stirring process in the first embodiment of the invention.

In FIG. 8A, the shown process is started in response to ON-set of power supply of the apparatus main body. At first, at step S501, initialization of the ink-jet printing apparatus is performed. This initialization is the known process and includes initialization of memory, initiation of temperature control for the printing head and so forth. Next, at step S502, stirring of ink is performed by rotating the ink stirring members 102 in the respective main tanks 11*a*, 11*b*, 11*c* and 11*d* at a speed of 150 r.p.m. for 5 min. By this, sedimentation and coagulation of the dye in the ink which can be caused by leaving the printing apparatus in non-printing state, can be successfully prevented.

After the stirring process, at step S503, a stirring timer is set. More specifically, after performing the foregoing stirring operation upon ON-set of power supply, measurement of the elapsed time (T1) by the timer is initiated for performing similar stirring operation a given time interval T0.

When the foregoing process is completed, the ink-jet printing apparatus becomes printing stand-by state at step S504. When starting of printing is judged in response to transfer of printing data, the printing sequence in step S505 and subsequent steps is performed in parallel to the process shown in FIG. 7. More specifically, at step S505, judgement is made whether elapsed time T1 measured by the timer reaches the predetermined time T0. If it does not reach T0, printing operation for one line, namely ink ejection associating with shifting of the carriage, feeding of the printing medium and so forth, is performed at step S506. Also, at step S507, judgement is made whether printing is completed or not. If not completed, the process of step S505 and subsequent steps is repeated. Here, the predetermined time T0 may be determined to be a period, in which sedimentation of ink will not cause significant problem, and thus is substantially determined depending upon characteristics of the ink. In the shown embodiment, the time TO is determined in the manner set out later.

When judgement is made that the measured time T1 is longer than or equal to the given period T0, main tank stirring process shown in FIG. 8B which is to be performed in parallel to the subsequent process in FIG. 8A, is initiated. In this main tank stirring process, at step S511, stirring operation similar to step S502 is performed. Then, at step S512, the stirring timer is reset to restart measurement of the elapsed time T1. Thereafter, the shown process is terminated. It should be noted that the stirring period at step S511 may be shorter than that in stirring at step S502. However, in any case, this period may be determined corresponding to a rotation speed of the stirring member and the period T0 to be set as the predetermined time and so forth.

It should be noted that while the foregoing process shown in FIG. 8A performs the stirring operation upon ON-set of the power supply and at every given time interval, it may be also possible to determine the timing to perform the stirring operation depending upon the elapsed time from ON-set of the power supply or depending upon the period where the apparatus is held inoperative.

Figure 9:
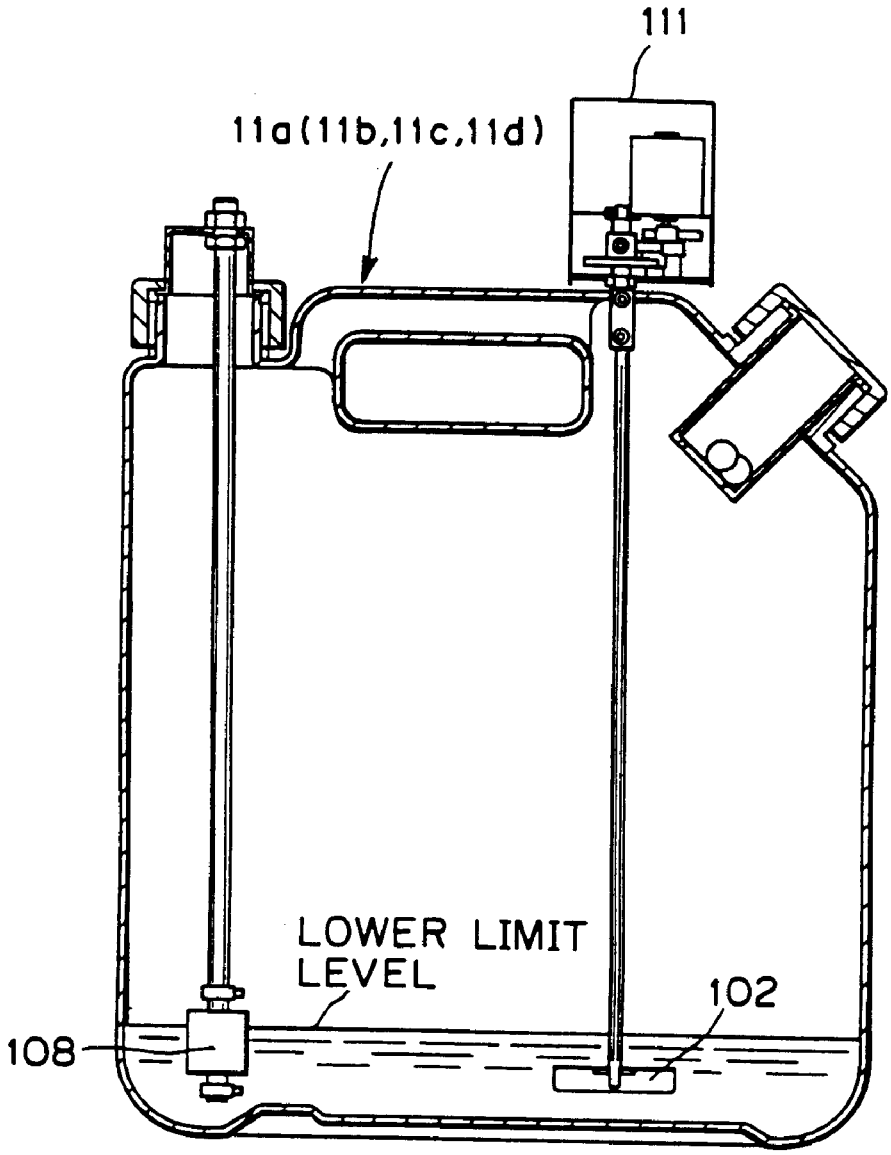
FIG. 9 is an illustration showing positional relationship of an ink stirring member in an ink tank shown in FIG. 1.

FIG. 9 is a section showing detail inside of the main tanks 11*a*, 11*b*, 11*c* and 11*d*. As shown in FIG. 9, in the main tank, by arranging the ink stirring member 102 below the ink level sensor 108, the ink stirring member 102 can rotate within the ink even when the ink level in the main tank becomes the lower limit level. By this structure, absorption of air and bubbling of water can be significantly suppressed.

Figure 10:
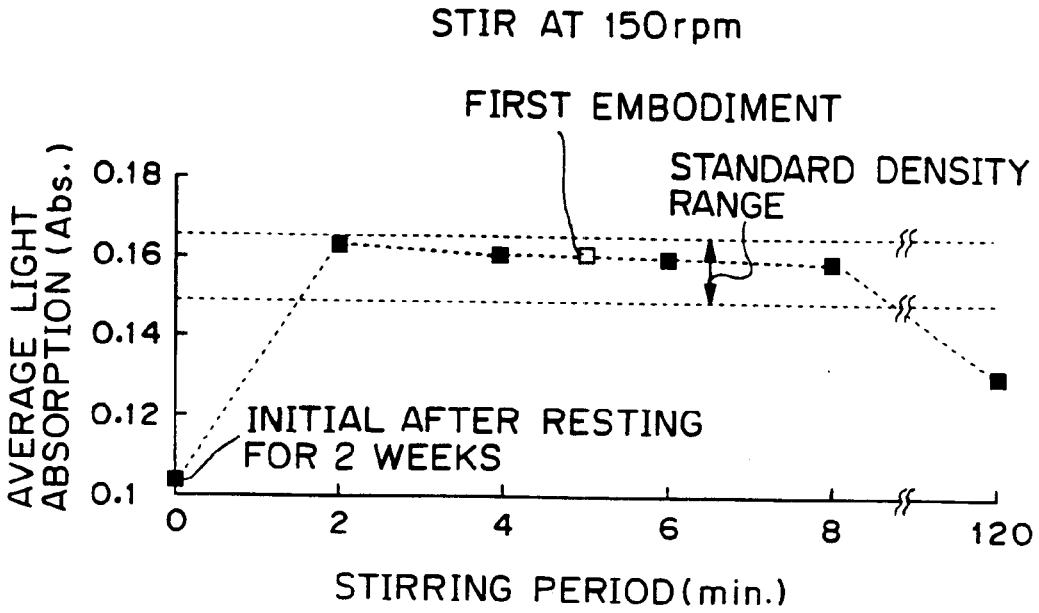
FIG. 10 is a diagram showing a relationship between an ink stirring period in a main tank and an average light absorption of the ink in an embodiment of the invention.

FIG. 10 is a diagram showing an average light absorption as one of an indication of ink density when the stirring period upon ON-set of the power supply is varied in the shown embodiment of the apparatus.

The measuring the average light absorption was measured by sampling the surface portion of the ink in the main tank and measuring light absorption with diluted liquid into 1000 times of solution (diluting liquid: ethanol 75%, neutral phosphoric salt pH reference liquid 2.5% and water 22.5%). The measuring device is U-3200 type automatic recording spectrum light absorption, Hitachi Seisakusho. The ink condition upon sampling is one after the stirring operation for the ink which is not stirred for two weeks, is performed for respective periods 0 min., 2 min., 4 min., 6 min., 8 min. and 120 min.

As can be clear from FIG. 10, when stirring is not performed (0 min.) after expiration of two week period or stirring is performed for relatively long period (120 min.), the density of the ink may not be within the density range to permit the ink to be used. Namely, when a range of the stirring period is 2 min. to 8 min. including 5 min. taken in the shown embodiment, the ink can be maintained in useful condition even when stirring is not performed continuously.

It should be noted that the composition of the ink employed in the shown embodiment was as follow:

| | |
|---|---|
| nickel chloride | 0.0003 parts |
| zinc sulfate | 0.0003 parts |
| calcium chloride | 0.002 parts |
| ion exchanging water | 25 parts |

All components set fourth above are mixed, and pH of a mixed liquid is adjusted by sodium hydrate. After stirring the mixed liquid for one hour, the floropoa-filter-FP-100 (tradename: Sumitomo Denkyo) for filtering is used to obtain inks a, b and c containing following dispersing dye solution I to III.

Preparation of Dispersing Dye Solution

β-naphthalene Sulfone Acid Formaldehyde Condensation

| | |
|---|---|
| substance | 20 parts |
| ion exchange water | 55 parts |
| diethylene glycol | 10 parts |

The foregoing components were mixed, the following disperse dye 15 parts were newly added to the solution of the mixture (namely 3 kinds of solution are prepared), and pre-mixing was performed for 30 min. Thereafter, dispersing process was performed in the following condition.

Disperse Dye

C. I. disperse yellow 198

C. I. disperse red 88

C. I. disperse blue 60 dispersing machine: sand grinder (Igarashi Kikai)

crushing medium: zirconium bead 1 mm diameter crushing medium filling rate: 50% by volume crushing period: 3 hours Furthermore, by filtering with floropoa-filter-FP-250 (tradename: Sumitomo Denkyo), coarse particles are removed to obtain dispersing dye liquids I to III.

Preparation of Inks (a to c)

| | |
|---|---|
| foregoing disperse dye liquid I, II or III | 40 parts, |
| tiodiglycol | 24 parts |
| diethylene glycol | 11 parts |
| sodium bisilicate | 0.0005 parts |
| ferrous sulfate | 0.001 parts |

It should be noted that as other disperse dyes,

C. I. disperse yellow 5, 24,54,64,79,82,83, 93, 99, 100, 119, 122, 124, 126, 160, 184:1, 186, 198, 199, 204, 211, 224 and 237;

C. I. disperse orange 13, 29, 31:1, 33, 49, 54, 55, 66, 73, 118, 119 and 163;

C. I. disperse red 54, 72, 73, 86, 88, 91, 92, 93, 111, 126, 127, 134, 135, 143, 145, 152, 153, 154, 159, 164, 167:1, 177, 181, 204, 206, 207, 221, 239, 240, 258, 277, 278, 283, 288, 311, 323, 343, 348, 356 and 362;

C. I. disperse violet 33;

C. I. disperse blue 56, 60, 73, 87, 113, 128, 143, 148, 154, 158, 165, 165:1, 165:2, 176, 183, 185, 197, 198, 201, 214, 224, 225, 257, 266, 267, 287, 354, 358, 365 and 368; and C. I. disperse green 6:1 and 9 are preferred.

Furthermore, these disperse dyes may be used solely or in combination of two or more kinds. The content of these dyes (total content in the case of two or more kinds are used in combination) is in a range of 0.5 Wt % to 25 Wt %, preferably 1.0 Wt % to 20 Wt %, and more preferably 1.5 Wt % to 15 wt %. If the content of the disperse dye is less than 0.5 Wt %, density of color development becomes insufficient. On the other hand, when the content of the disperse dye exceeds 25 Wt %, degradation of storage stability of the ink or failure of ejection due to increasing of viscosity or separation out associated with evaporation of ink in the vicinity of the tip end of the ejection openings can be caused.

(Modification of the First Embodiment)

Figure 11A:
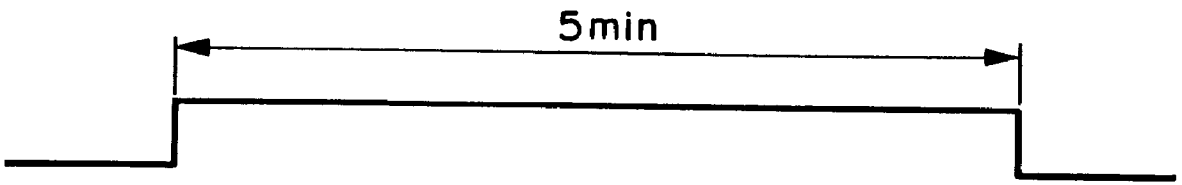
FIGS. 11A, 11B and 11C are timing charts showing manner of driving of the ink stirring member, to which the present invention is applied, respectively.
Figure 11B:
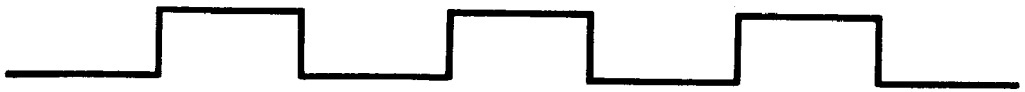
Figure 11C:
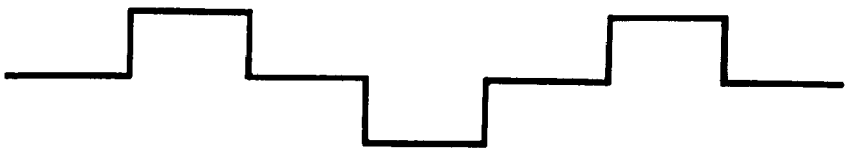

FIGS. 11A to 11C are timing charts showing three examples of manner of driving of the ink stirring member.

FIG. 11A shows the manner of driving as discussed in the first embodiment, and continuously driving the ink stirring member for 5 min.

FIG. 11B is not for continuously driving the ink stirring member for 5 min. as set forth above but to drive intermittently with a given time interval. Also, FIG. 11C is to perform intermittent driving and the rotating direction of the stirring member is reversed alternately.

The time interval in intermittent driving is a period to cause a given flowability in the ink by stirring. In the shown embodiment, the time interval is approximately 10 sec. or more. With such intermittent driving, reduction of driving energy and stirring period can be realized.

Figure 12:
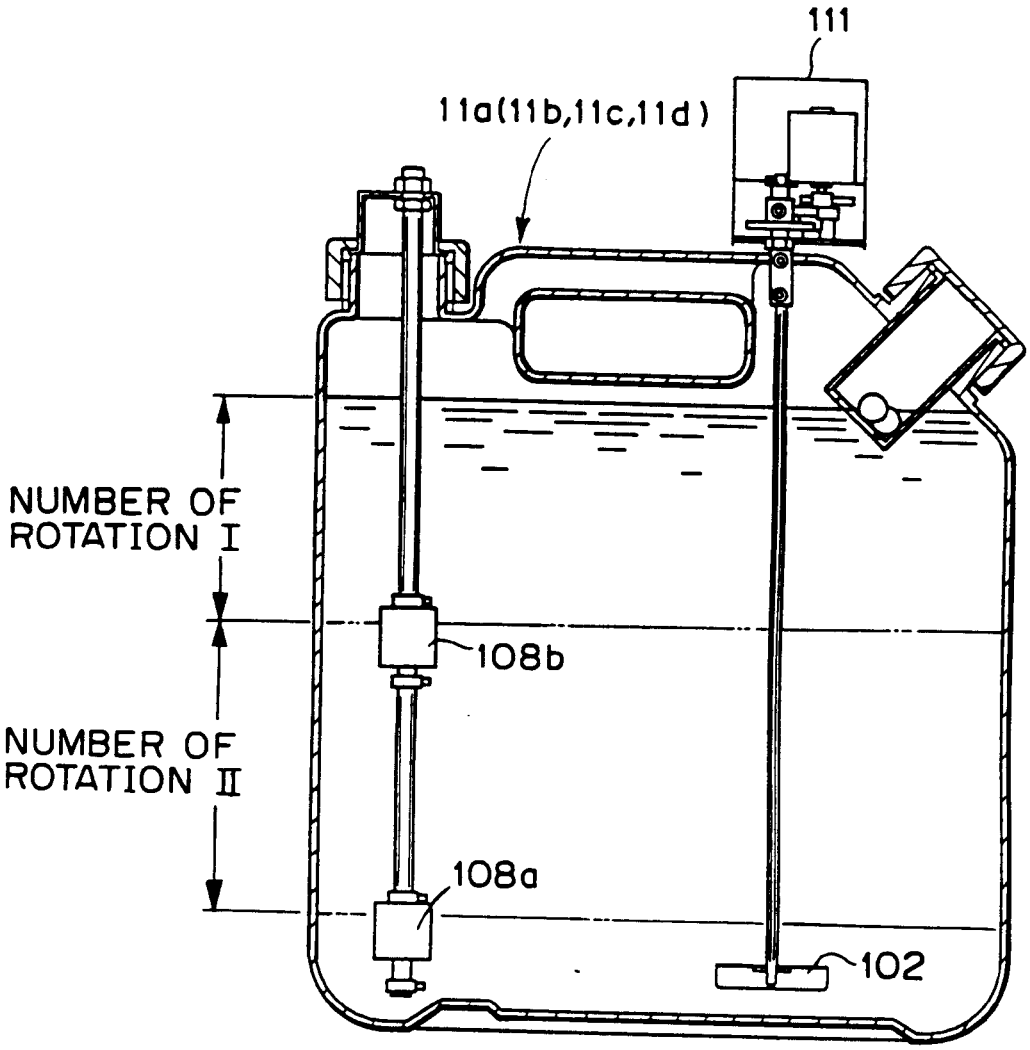
FIG. 12 is an illustration for explaining a construction for stirring main tank in a modification of the first embodiment.

FIG. 12 is an illustration showing another embodiment for the construction for stirring the ink in the main tank. As shown, for the main tank 11*a*, 11*b*, 11*c* and 11*d*, respectively, two liquid level sensors 108*a* and 108*b* are provided for detecting the liquid level at two levels. By this, while the ink amount is relatively large until detection of the liquid level by the liquid level sensor 108*b*, the rotation speed of the stirring member is set to be relatively high rotation speed I. On the other hand, below the liquid level to be detected by the liquid level sensor 108*b* and up to the liquid level to be detected by the liquid level sensor 108*a*, the stirring member is driven to rotate at the rotation speed II which is lower than the rotation speed I. With such construction, irrespective of the ink amount in the main tank, uniform stirring can be realized.

(Second Embodiment)

In the embodiment illustrated hereinafter, construction for performing appropriate printing depending upon characteristics of the ink to be used in the case where various kinds of inks are used depending upon the kinds of the cloth to be printed, will be discussed.

In the shown embodiment, as different kinds of inks reactive dye ink and disperse dye ink are employed. Hereinafter, the composition of these inks will be discussed.

1. Reactive Dye Ink

| | |
|---|---|
| reactive dye (shown below) | 4 to 20 parts |
| tiodiglycol | 24 parts |
| diethylene glycol | 11 parts |
| potassium chloride | 0.004 parts |
| sodium sulfate | 0.002 parts |
| sodium bisilicate | 0.001 parts |
| iron chloride | 0.0005 parts |
| water | 45 to 61 parts |

The dye to be used is as follow:

Yellow Ink

C. I. Reactive Yellow 95

Red Ink

C. I. Reactive Red 218

Blue Ink

C. I. Reactive Blue 49

Green Ink

C. I. Reactive Green 8

Black Ink

C. I. Reactive Black 39

The foregoing components are mixed (to make the total amount of the reactive dye and water 65 parts). The mixture solution is adjusted by sodium hydrate at pH 8.4. After stirring for 2 hours, filtering is performed with floropore filter-FP-100 (tradename: Sumitomo Denko) to obtain the reactive dye ink.

2. Disperse Dye Ink (a) Disperse Dye Liquid

β-naphthalene Sulfon Acid Formaldehyde

| | |
|---|---|
| condensation element | 20 parts |
| ion exchange water | 55 parts |
| diethylene glycol | 10 parts |

The foregoing components are mixed, 15 parts of the following disperse dye is newly added to the mixed solution (namely three kinds of solution are prepared), and premixing is performed for 30 min. Thereafter, dispersing process is performed in the following condition. It should be note that "part" and "%" used in this specification are by weight unless otherwise specified.

(b) Disperse Dye

C. I. Disperse Yellow 198

C. I. Disperse Red 88

C. I. Disperse Blue 60 dispersing machine: side grinder (Igarashi Kikai)

crushing medium: zilconium bead 1 mm diameter crushing medium filling rate: 50% by volume crushing period: 3 hours Furthermore, by filtering with floropore filter-FP-250 (tradename: Sumitomo Denko), large grain size particle is removed to obtain the disperse dye.

(c) Preparation of Ink

| | |
|---|---|
| Foregoing Disperse Dye Liquid | 40 parts |
| tiodiglycol | 24 parts |
| diethylene glycol | 11 parts |
| sodium bisilicate | 0.0005 parts |
| ferrous sulfate | 0.001 parts |
| nickel chloride | 0.0003 parts |
| zinc sulfate | 0.0003 parts |
| calcium chloride | 0.002 parts |
| ion exchange water | 25 parts |

All of the foregoing components are mixed. Then, the pH of the mixture liquid is adjusted by sodium hydrate to be PH7 to PH9. After stirring for 2 hours, filtering is performed with floropore filter-FP-100 (tradename: Sumitomo Denko) to obtain the disperse dye ink.

Next, with respect to the inks discussed in above sections 1 and 2, printing head driving condition and various operation parameters relating to ejection recovery operation, to be set on a basis of conditions corresponding to characteristics of the ink to be used, will be discussed.

3. Printing Head Driving Condition

| | |
|---|---|
| head driving pulse: | Voltage 24 V, pulse width 3 to 20 $\mu$s |
| controlled head temperature: | 20 to 60° C. |
| driving frequency: | 0.5 kHz to 8 kHz |
| (Printing density : | 200 dpi to 1200 dpi) |

4. Condition of Substantive Ejection Recovery Operation (Including Ink Circulating Operation to be Performed Under Capping Condition) Frequency of Ejection Recovery

| | |
|---|---|
| frequency of ejection recovery operations | once per n lines |
| ink pressurizing period | 0 sec. to 60 sec. |
| wiping speed | 20 mm/sec to 400 mm/sec |

5. Condition of Medium Ejection Recovery Operation Frequency of Ejection Recovery

| | |
|---|---|
| Operation | once per m lines |
| number of ejection in preliminary ejection operation | 0 droplet to 50000 droplets |
| wiping speed | 20 mm/sec to 400 mm/sec |

6. Condition of Wiping Operation

| | |
|---|---|
| frequency of wiping operation | once per 1 line |
| wiping speed | 20 mm/sec to 400 mm/sec |

7. Condition of Preliminary ejection

| | |
|---|---|
| frequency of preliminary ejection operation | once per Y line |
| number of ejection in Preliminary ejection operation | 0 droplet to 2000 droplets |

8. Condition of Bubble Removal Operation

| | |
|---|---|
| ink pressurizing period | 0 to 60 sec |
| ink pressurizing motor speed | 0 pps to 400 pps |
| frequency of bubble removal operation | once per X line |

9. Condition of Ink Stirring Operation

| | |
|---|---|
| main tank stirring motor speed | 0 pps to 400 pps |
| main tank stirring motor operation period | 0 sec to 600 sec |
| operation timing of main tank stirring motor | once per T1 period |

10. Output γ Table

The foregoing printing head driving condition and various operation parameters associated with the ejection recovery operation, as described later, are preliminarily set per kind of ink depending upon the characteristics of the kind of ink, and is automatically selected depending upon the kind of ink recognized by means of the ink kind recognizing means discussed later or by manual input of an operator.

The medium ejection recovery operation set forth in the foregoing section 5 is one to be mainly performed when the kind of ink is the disperse dye ink and is intended to remove dispersed broken substance caused in heating of the disperse dye from the ink ejection opening. For the purpose of discharging of the dispersed broken substance, it is more effective means than discharging of ink by pressurization of the ink.

The operation to be performed in the medium ejection recovery operation is to perform the preliminary ejection of greater number of ink droplets than that in the normal preliminary ejection. The medium ejection recovery operation is differentiated from the normal preliminary ejection operation which is mainly intended to prevent increasing of viscosity of the ink by regularly performing ink ejection, in the task.

In the light of the task, the normal preliminary ejection operation is required to be performed in a frequency of one per several lines. On the other hand, the medium ejection recovery operation is suitably performed at a frequency of once per several tens or several hundreds lines as long as the dispersed broken substance can be effectively removed from the ink ejection openings.

Also, the wiping operation during the medium ejection recovery operation is to prevent a part of the relatively large amount of ink ejected during medium ejection recovery operation from depositing on the ink ejection surface of the printing head. Therefore, by performing wiping operation similarly to that during substantive ejection recovery operation, the ink ejection surface can be maintained in normal condition.

It should be noted that, when the kind of ink to be used is the disperse dye ink, the stirring operation shown in FIGS. 8A and 8B should be performed.

Figure 13:
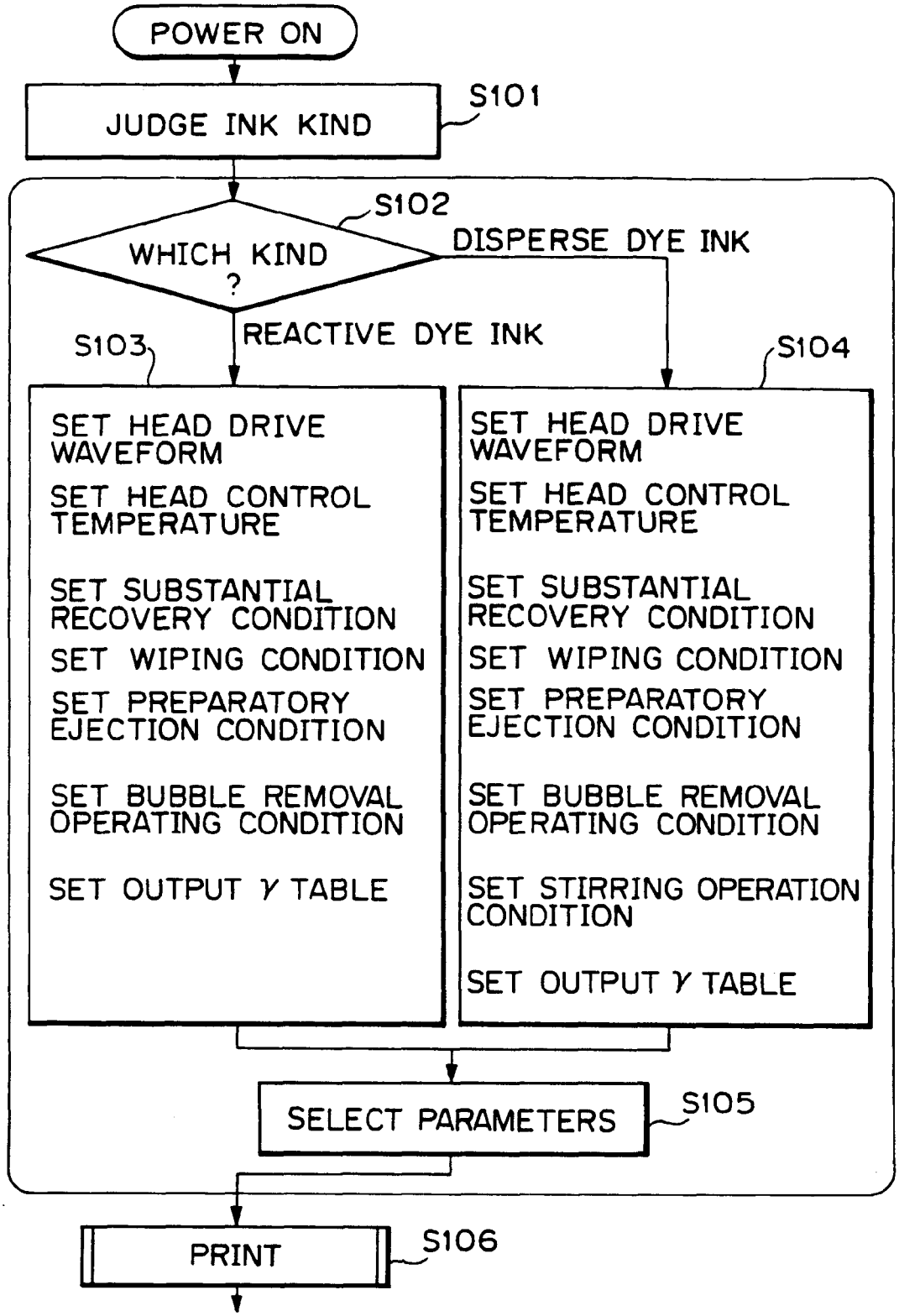
FIG. 13 is a flowchart showing a process for setting printing operation per kinds of inks in a second embodiment of the invention.

FIG. 13 is an flowchart showing a procedure for setting respective operating conditions in the foregoing sections 3 to 9 depending upon either the reactive dye ink or the disperse dye ink to be used in printing. Such setting is performed in advance of initiation of printing operation. More specifically, the operating conditions adapted to respective kinds of inks are appropriately set within a range identified in the foregoing sections 3 to 9. The set condition is written in a memory of the control circuit 16 for permitting writing and reading. Also, the shown procedure of the process illustrated in FIG. 13 is stored in ROM of the control circuit 16. Furthermore, designation of the kind of the ink is done by manual input by the operator through an input portion 90 (see FIG. 1). In the alternative, it may be possible to read the kind of the ink by a detecting means provided in the ink tank so forth.

In FIG. 13, when power supply for the apparatus main body is turned ON, as set forth above, the kind of the ink is judged depending upon the input by the operator at step S101 and S102. More specifically, in the shown embodiment, judgement is made as to whether the reactive dye ink or disperse dye ink is set to be used. At step S101, the setting information is read out, and at step S102, judgement is made as to whether the reactive dye ink or the disperse dye ink is set as the ink to be used for printing.. When judgement is made that the set ink is the reactive dye ink, the process is advanced to step S103. On the other hand, when judgement is made that the set ink is the disperse dye ink, the process is advanced to step S104. At steps S103 and 104, setting of the printing condition, such as printing head driving waveform and so forth, is performed. Concrete setting of conditions set forth above is performed as follows. In the case that the judgement is made that the kind of the ink is the reactive dye ink, in step S103, the conditions are set such that the pulse width of the head driving pulse is 10 μsec, the controlled head temperature is 35° C., the substantive ejection recovery operation is performed once per 100 lines of printing, the wiping operation is performed once per 5 lines, the preliminary ejection operation is performed once per 2 lines of printing with number of ejection being 100, and the bubble removal operation is not performed. On the other hand, in the case that the judgement is made that the kind of the ink is the disperse dye ink, in step S102, the conditions are set such that the pulse width is 8 μsec, the controlled head temperature is 30° C., the substantive ejection recovery operation is performed once per 50 lines, the wiping operation is performed once per 2 lines, the preliminary ejection operation is performed once per 2 lines with number of ejection being 200, and the bubble removal operation and the ink stirring operation are performed.

Among the operations associated with various conditions to be set, the ink stirring operation is performed only in the case where the used ink is the disperse dye ink which is easy to cause coagulation or sedimentation of the ink dye as set out in the first embodiment. Once setting of the operating condition is done at either step S103 or step S104, process of selection of the parameters for respective operation is performed at step S105. Then, printing operation is performed at step S106.

It should be noted that an ink kind judging means may be realized in the construction provided on the ink tank. In such case, the construction may be realized by differentiating the configuration of the ink filling opening of an ink supply container (not shown) for supplying ink to the main tank 11*a* (11*b*, 11*c*, 11*d*) a shown in FIG. 2 and by mechanically detecting the configuration of the ink filling opening of the ink supply container as engaged with the ink inlet of the main tank. In the alternative, it is also possible to provide a unit for judging the kind of the ink depending upon optical characteristics, electrical conductivity, wetting ability, viscosity, surface tension, pH and so forth.

While the foregoing embodiment has been discussed in terms of selection of two kinds of inks, i.e. the reactive dye ink and the disperse dye ink, application of the present invention is not limited to such two kinds of inks but can be extended to other kinds of inks. Also, the invention may be applicable for selection of more than two kinds of inks.

Further, in the case of using a plurality of kinds of inks for one ink-jet printing apparatus, ink exchanging operation is performed as follows.

In FIG. 2, an ink supply system of a main tank side is separated at separating portions 2000 and other ink supply system of the main tank side is set. On the other hand, to an ink supply system of a printing head side, cleaning is performed.

On the other hand, application of the present invention is not limited to the textile printing but is widely extended to general printing.

As can be clear from the discussion given hereabove, with the first embodiment and modification thereof, stirring operation of the stirring means can be made variable. Therefore, it becomes possible to intermittently perform stirring operation for a given period during printing operation of the printing apparatus. As a result, trapping of bubble in the ink during continuous stirring operation can be reduced. Furthermore, the lift of the motor to be the source of driving in the stirring operation is substantially not required to consider. On the other hand, re-coagulation of the ink by stirring in long period can be successfully prevented.

On the other hand, in the second embodiment, the printing operation and recovery operation for maintaining ejecting function of the printing head can be set depending upon kind of the ink to be used. Thus, by performing printing operation and recovery operation for the printing head under the set condition, printing operation can be performed in optimal condition with respect to different kinds of inks.

The present invention achieves distinct effect when applied to a recording head or a recording apparatus which has means for generating thermal energy such as electrothermal transducers or laser light, and which causes changes in ink by the thermal energy so as to eject ink. This is because such a system can achieve a high density and high resolution recording.

A typical structure and operational principle thereof is disclosed in U.S. Pat. Nos. 4,723,129 and 4,740,796, and it is preferable to use this basic principle to implement such a system. Although this system can be applied either to on-demand type or continuous type ink jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to recording information; second, the thermal energy induces sudden temperature rise that exceeds the nucleate boiling so as to cause the film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording U.S. Pat. Nos. 4,558,333 and 4,459,600 disclose the following structure of a recording head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laying-open Nos. 123670/1984 and 138461/1984 in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

The present invention can be also applied to a so-called full-line type recording head whose length equals the maximum length across a recording medium. Such a recording head may consist of a plurality of recording heads combined together, or one integrally arranged recording head.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. Examples of the recovery system are a capping means and a cleaning means for the recording head, and a pressure or suction means for the recording head. Examples of the preliminary auxiliary system are a preliminary heating means utilizing electrothermal transducers or a combination of other heater elements and the electrothermal transducers, and a means for carrying out preliminary ejection of ink independently of the ejection for recording. These systems are effective for reliable recording.

The number and type of recording heads to be mounted on a recording apparatus can be also changed. For example, only one recording head corresponding to a single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the recording signal is applied can be used: for example, inks can be employed that solidify at a temperature lower than the room temperature and are softened or liquefied in the room temperature. This is because in the ink jet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the recording medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the recording signal. In such cases, the ink may be retained in recesses or through holes formed in a porous sheet as liquid or solid substances so that the ink faces the electrothermal transducers as described in Japanese Patent Application Laying-open Nos. 56847/1979 or 71260/1985. The present invention is most effective when it uses the film boiling phenomenon to expel the ink.

Furthermore, the ink jet recording apparatus of the present invention can be employed not only as an image output terminal of an information processing device such as a computer, but also as an output device of a copying machine including a reader, and as an output device of a facsimile apparatus having a transmission and receiving function.

The present invention has been described in detail with respect to various embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. An ink jet printing apparatus usable with ink including water-based ink, in which a water-insoluble dye or a dye having low solubility is dispersed, to perform printing by ejecting the ink to a printing medium by using an ink-jet head, comprising:

executing means for executing an operation associated with printing and specific to a kind of ink to be employed in printing, the kind of ink being distinguished by solubility of the dye of the ink in water, wherein the operation includes an operation of stirring the ink and stopping of stirring the ink and an operation of executing printing modes in which driving conditions of the ink-jet head or ejection recovery operations for the ink-jet head differ from each other.

2. An ink-jet printing apparatus as claimed in claim 1, wherein said ink-jet head includes an electrothermal transducer for generating energy to be used for ejecting the ink.

3. An ink-jet printing apparatus as claimed in claim 2, wherein said ink-jet head includes a plurality of ejection openings for ejecting different colors of inks per the kind of the ink.

4. An ink-jet printing apparatus as claimed in claim 3, wherein said printing medium is a cloth.

5. An ink-jet printing apparatus for performing printing by ejecting an ink to a printing medium by using an ink-jet head, comprising:

judging means for making judgement of a kind of the ink to be ejected from the ink-jet head, the kind of ink being distinguished by solubility of a dye of the ink in water;

setting means for preliminarily setting printing modes per the kind of ink; and control means for selecting one printing mode among the printing modes preliminarily set by said setting means depending upon the kind of ink judged by said judging means and for performing printing in the one printing mode selected, wherein the printing modes include printing modes in which driving conditions of the ink-jet head or ejection recovery operations for the ink-jet head differ from each other.

6. An ink-jet printing apparatus as claimed in claim 5, wherein a driving condition of the ink-jet head is set per the kind of ink in the printing modes set by said setting means.

7. An ink-jet printing apparatus as claimed in claim 5, wherein an ejecting recovery operation for the ink-jet head is set per the kind of ink in the printing modes set by said setting means.

8. An ink-jet printing apparatus as claimed in claim 5, wherein, in at least one of the printing modes set by said setting means, an operation mode for driving an ink stirring means provided in an ink supply passage to the ink-jet head is set in correspondence with the kind of the ink.

9. An ink-jet printing apparatus as claimed in claim 5, wherein in the printing modes set by said setting means, an output γ table for correcting a printing signal is set per the kind of the ink.

10. An ink-jet printing apparatus as claimed in claim 5, wherein said ink-jet head includes an electrothermal transducer for generating energy to be used for ejecting the ink.

11. An ink-jet printing apparatus as claimed in claim 10, wherein said ink-jet head includes a plurality of ejection openings for ejecting different colors of inks per the kind of the ink.

12. An ink-jet printing apparatus as claimed in claim 11, wherein said printing medium is a cloth.

13. An ink jet printing apparatus using a printing head for ejecting ink to a cloth to perform printing, the ink being supplied to the printing head from an ink tank for storing the ink, said apparatus comprising:

stirring means for stirring the ink in the ink tank;

recovery means for executing a preliminary ejection operation as a recovery operation for the printing head, the preliminary ejection operation comprising the printing head being caused to eject the ink every time that a predetermined amount of printing is performed;

ink kind distinguishing means for inputting or distinguishing a kind of the ink ejected from the printing head for printing, the kind of the ink inputted or distinguished being reactive dye ink containing a reactive dye or disperse dye ink containing a disperse dye; and control means for controlling a driving condition of the printing head, the preliminary ejection operation by said recovery means, and a stirring operation by said stirring means, based on the kind of the ink inputted or distinguished by said ink kind distinguishing means, to perform printing, wherein said control means causes said recovery means to vary the number of times of ejection in the preliminary ejection operation based on whether the reactive dye ink or the disperse dye ink is inputted or distinguished by said ink kind distinguishing means, and, only when the kind of ink inputted or distinguished is the disperse dye ink, said control means causes said stirring means to stir the ink and causes said recovery means to further execute the preliminary ejection operation every time when an amount of printing greater than the predetermined amount is performed.

14. An ink jet printing apparatus as claimed in claim 13, wherein the printing head comprises an electro-thermal transducer for generating thermal energy for ejecting ink.

15. An ink jet printing apparatus as claimed in claim 13, wherein the printing head comprises a plurality of ejection elements respectively ejecting different colors of inks, and is capable of performing color printing with the different colors of inks according to the kind of ink.

* * * * *

UNITED STATES PATENT AND TRADEMARK OFFICE

CERTIFICATE OF CORRECTION

PATENT NO. : 6,488,348 B1
DATED : December 3, 2002
INVENTOR(S) : Miura et al.

It is certified that error appears in the above-identified patent and that said Letters Patent is hereby corrected as shown below:

Title page,
Item [75], Inventors, "Takeshi Irizawa, Oizumi-machi" should read -- Takeshi Irizawa, Tokyo --.
Item [56], References Cited, FOREIGN PATENT DOCUMENTS, "363147648 A" should read -- 63-147648A --.

Column 2,
Line 5, "following" should read -- the following --.
Line 31, "such" should read -- such a --.
Line 34, "Such" should read -- Such a --.

Column 4,
Line 1, "embodiment" should read -- embodiments --.
Line 44, "EMBODIMENT" should read -- EMBODIMENTS --.
Line 53, "instance," should read -- instances, --.

Column 5,
Line 2, "a" should be deleted.
Line 50, "During" should read -- during --.

Column 6,
Line 16, "in" should read -- for a --.
Line 24, "leaving" should read -- leaving it --.
Line 49, "detail" should read -- details --.

Column 9,
Line 24, "a" should read -- at a --.
Line 64, "detail" should read -- details --.

Column 10,
Line 17, "periods" should read -- periods of --.
Line 28, "follow:" should read -- follows: --.
Line 40, "following" should read -- the following --.

Column 12,
Line 21, "follow:" should read -- follows: --.
Line 50, "is" should read -- are --.

Column 13,
Line 64, "Preliminary" should read -- preliminary --.

UNITED STATES PATENT AND TRADEMARK OFFICE

CERTIFICATE OF CORRECTION

PATENT NO. : 6,488,348 B1
DATED : December 3, 2002
INVENTOR(S) : Miura et al.

It is certified that error appears in the above-identified patent and that said Letters Patent is hereby corrected as shown below:

Column 14,
Line 59, “an” should read -- a --.

Column 15,
Line 7, “so” should read -- and so --.
Line 10, “step” should read -- steps --.
Line 16, “printing..” should read -- printing. --.
Line 51, “such” should read -- such a --.
Line 55, “a” should read -- as --.

Column 16,
Line 5, “other” should read -- another --.
Line 22, “in” should read -- for a --.
Line 38, “is” should read -- are --.
Line 67, “to” should read -- into --.

Signed and Sealed this

Fourteenth Day of October, 2003

JAMES E. ROGAN
*Director of the United States Patent and Trademark Office*